US006243880B1

(12) United States Patent
Lyden

(10) Patent No.: US 6,243,880 B1
(45) **Date of Patent: *Jun. 12, 2001**

(54) ATHLETIC SHORTS

(76) Inventor: Robert M. Lyden, 18261 SW. Fallatin Loop, Aloha, OR (US) 97707

( * ) Notice: Subject to any disclaimer, the term of this patent is extended or adjusted under 35 U.S.C. 154(b) by 0 days.

This patent is subject to a terminal disclaimer.

(21) Appl. No.: 09/474,195

(22) Filed: Dec. 29, 1999

(51) Int. Cl.[7] ..... A41B 9/00
(52) U.S. Cl. ..... 2/228; 2/227; 2/400; 2/238
(58) Field of Search ..... 2/69, 79, 227, 2/228, 238, 400–408

(56) References Cited

U.S. PATENT DOCUMENTS

| | | |
|---|---|---|
| D. 98,867 | 3/1936 | Lee . |
| D. 233,633 | 11/1974 | Burkard . |
| D. 238,828 | 2/1976 | Reed . |
| D. 268,454 | 4/1983 | Novo . |

(List continued on next page.)

FOREIGN PATENT DOCUMENTS

| | | | |
|---|---|---|---|
| 664878 | 4/1988 | (CH) | 2/400 |
| 89/07896 | 9/1989 | (WO) | 2/403 |

OTHER PUBLICATIONS

Allsop/Sims Vibration.
Calvin Klein Sport Brief Package.
Seaquest Catalogue.
Boxer Style Shorts, #8, p. 539, Sears Spring/Summer 1978 Catalog, GUA 2900 Library.

* cited by examiner

*Primary Examiner*—Gloria M. Hale
(74) *Attorney, Agent, or Firm*—Westman, Champlin & Kelly, P.A.

(57) ABSTRACT

The present invention teaches novel athletic shorts for male and female wearers that permit relatively unrestricted flexion and extension of the legs, and distention of the abdomen during breathing. The preferred athletic shorts can include an anterior side having a superior edge forming a V or U shape, and retention means substantially consisting of non-stretchlastic material. The athletic shorts can include a preferred range with respect to minimum width in the area between the openings for accomodating the wearer's legs, and also an area of differential elastic and stitching near the point of minimum width. Further, the present invention teaches athletic shorts that permit the male reproductive organs to be substantially suspended naturally. This is believed to lower the temperatures to which the testes are subjected thereby increasing the rate and quality of spermatogenesis, and to facilitate greater heat dissipation. Further, this characteristic is believed to facilitate optimal thermoregulation.

19 Claims, 11 Drawing Sheets

U.S. PATENT DOCUMENTS

| | | | | |
|---|---|---|---|---|
| D. 387,539 | | 12/1997 | Wagner . | |
| D. 403,487 | | 1/1999 | Crupi et al. . | |
| 620,435 | | 2/1899 | Fisher . | |
| 763,683 | * | 6/1904 | Magoris . | |
| 1,212,805 | | 1/1917 | Newman . | |
| 1,277,839 | | 9/1918 | Birkenfeld . | |
| 1,288,673 | | 12/1918 | Potterf . | |
| 1,662,981 | | 3/1928 | Pazowski . | |
| 1,737,882 | | 12/1929 | Hatch . | |
| 1,861,383 | | 5/1932 | Ficcio . | |
| 1,998,140 | | 4/1935 | Loew . | |
| 2,034,312 | * | 3/1936 | Rubin | 2/228 |
| 2,128,876 | | 8/1938 | Boysen . | |
| 2,216,897 | | 10/1940 | Zoob . | |
| 2,232,246 | * | 2/1941 | Klein | 2/228 |
| 2,401,457 | | 6/1946 | Bryant . | |
| 2,408,723 | * | 10/1946 | Arpin et al. . | |
| 2,411,922 | | 12/1946 | Keohane . | |
| 2,419,867 | * | 4/1947 | Woodman . | |
| 2,623,210 | | 12/1952 | Chatfield . | |
| 2,652,053 | | 9/1953 | Dann . | |
| 2,742,647 | | 4/1956 | Khalil . | |
| 2,872,685 | | 2/1959 | Denbo . | |
| 2,983,924 | * | 5/1961 | Cohen et al. | 2/228 |
| 3,141,458 | * | 7/1964 | Burbank | 2/228 |
| 3,166,764 | | 1/1965 | Stedman et al. . | |
| 3,169,530 | | 2/1965 | Grishman . | |
| 3,207,155 | | 9/1965 | Casey . | |
| 3,517,666 | | 6/1970 | Atlee . | |
| 3,621,846 | * | 11/1971 | Lehman . | |
| 3,654,634 | * | 4/1972 | Torres . | |
| 3,963,022 | * | 6/1976 | Rotello . | |
| 4,004,297 | | 1/1977 | Polack . | |
| 4,009,495 | | 3/1977 | Faust . | |
| 4,173,976 | | 11/1979 | Bloomquist et al. . | |
| 4,223,408 | | 9/1980 | Sullivan . | |
| 4,261,060 | | 4/1981 | Zawacki . | |
| 4,371,989 | | 2/1983 | Polsky . | |
| 4,470,156 | | 9/1984 | Duerbeck et al. . | |
| 4,488,317 | | 12/1984 | Polsky . | |
| 4,494,250 | | 1/1985 | Sheppard et al. . | |
| 4,523,337 | * | 6/1985 | Leibowitz | 2/237 |
| 4,580,297 | | 4/1986 | Maejima . | |
| 4,602,388 | | 7/1986 | Underwood et al. . | |
| 4,619,004 | | 10/1986 | Won . | |
| 4,625,336 | | 12/1986 | Derderian . | |
| 4,669,130 | | 6/1987 | Brown . | |
| 4,670,913 | | 6/1987 | Morell et al. . | |
| 4,702,239 | * | 10/1987 | Ichikawa . | |
| 4,870,958 | | 10/1989 | Webster . | |
| 4,920,769 | * | 5/1990 | Rickerl | 66/176 |
| 4,972,525 | | 11/1990 | Hwang . | |
| 5,023,957 | | 6/1991 | Harvey . | |
| 5,029,345 | | 7/1991 | Angheluta et al. . | |
| 5,040,245 | | 8/1991 | Staley . | |
| 5,109,546 | | 5/1992 | Dicker . | |
| 5,131,100 | | 7/1992 | Atwater et al. . | |
| 5,144,697 | | 9/1992 | Sandbeck . | |
| 5,152,014 | | 10/1992 | Marx et al. . | |
| 5,157,793 | | 10/1992 | Michels . | |
| 5,237,706 | * | 8/1993 | Nalbandian . | |
| 5,243,974 | * | 9/1993 | Allen . | |
| 5,275,592 | * | 1/1994 | Grizzaffi . | |
| 5,379,462 | | 1/1995 | Morgan et al. . | |
| 5,524,298 | * | 6/1996 | Plunkett . | |
| 5,547,466 | * | 8/1996 | McRoberts et al. . | |
| 5,598,587 | | 2/1997 | Wada . | |
| 5,647,065 | * | 7/1997 | Richerson . | |
| 5,822,802 | | 10/1998 | Chou . | |
| 5,870,779 | * | 2/1999 | Heron . | |
| 5,875,495 | * | 3/1999 | Thrower . | |
| 5,915,536 | * | 6/1999 | Alberts et al. | 2/227 |
| 6,026,517 | * | 2/2000 | Kang . | |
| 6,038,703 | * | 3/2000 | Chung . | |
| 6,061,840 | * | 5/2000 | Alligator . | |

ATHLETIC SHORTS

FIELD OF THE INVENTION

The present invention relates to articles of apparel, and in particular, to athletic shorts which are suitable for use by male and female wearers.

BACKGROUND OF THE INVENTION

Over the last twenty years men's athletic shorts have evolved such that they frequently feature a textile outer layer or shell, and include a integral inner liner made of stretchlastic material which may include elastic material surrounding the openings for the legs, thus containing and obscuring the male reproductive organs. This inner liner also exerts force upon the male reproductive organs, that is, the penis and scrotum containing the testes, and both elevates and presses the male reproductive organs against the pubic area of the torso. Prior to the introduction of this type of athletic shorts, men frequently wore separate conventional underwear, boxer shorts, briefs, or jock straps underneath athletic shorts consisting of an outer layer or shell. This made for some redundancy in clothing, and it frequently happened that the outer garment would slide out of position relative to the undergarment resulting in an undesirable aesthetic appearance. Alternately, some men would brave wearing nothing at all under athletic shorts consisting of an outer layer or shell, but this would frequently result in chaffing, discomfort, and could present an offense to modesty, in particular, as the presence of perspiration could cause the outer layer or shell to cling to a wearer's anatomy.

While conventional prior art athletic shorts including an integral inner liner which elevate and press the male reproductive organs against the pubic area of the torso have solved some problems, they have unfortunately introduced others. Such athletic shorts do not permit the male reproductive organs to be suspended naturally. And it is well known that the degree to which the scrotum descends or elevates is at least partially dependent upon temperature. Elevating and pressing the scrotum and testes against the pubic area of the torso therefore potentially subjects these organs to higher than normal temperatures. This is now known to induce the so-called "Jockey Shorts Effect," and can cause a decrease in the rate and quality of spermatogenesis, that is, sperm production. Research has been conducted on the "Jockey Shorts Effect," e.g., see the following articles:

A. Zorgniotti, et al., "The Effect of Clothing on Scrotal temperature in Normal Men and Patients with Poor Semen," *Urology,* February, 1982; 19(2):176–178.

J. Mulcahy, "Scrotal Hypothermia and the Infertile Man," *Journal of Urology,* September, 1984; 132(3):469–470.

R. Mieusset, "Association of Scrotal Hyperthermia with Impaired Spermatogenesis in Infertile Men," *Fertility and Sterility,* December, 1987; 48(6):1006–1011.

G. Brindley, "Deep Scrotal Temperature and the Effect on it of Clothing, Air Temperature, Activity, Posture and Paraplegia," *British Journal of Urology,* February, 1982; 54(1):49–50.

Conventional prior art athletic shorts including an inner liner which elevate and press the male reproductive organs against the pubic area of the torso also decrease heat radiation and dissipation from the body. It is well known that the head, hands, feet, and male reproductive organs are the most vascularized portions of the male body and greatly contribute to heat dissipation.

Further, convention prior art athletic shorts including an inner liner which elevate and press the male reproductive organs against the pubic area of the torso are believed to adversely affect thermoregulation. In this regard, see J. Hales and J. Hutchinson, "Metabolic, Respiratory and Vasomotor Responses to Heating the Scrotum of the Ram," *J. Physiology,* London, 1971, pages 353–375, and D. Ingram and K. Legge, "The Influence of Deep Body And Skin Temperatures on Thermoregulatory Responses to Heating of the Scrotum in Pigs," *J. Physiology,* London, 1972, pages 477–487. The physiology of a pig is considered not far distant from man, thus some of the internal organs of pigs are sometimes transplanted into humans. Ingram found that merely exposing the scrotum of a pig to changing temperatures did indeed induce widespread changes in thermoregulation, such as shunting of blood to the skin, something which is known to have dramatic effects in the context of exercise physiology and athletic performance. The effects of various apparel constructions on heat dissipation and thermoregulation in man can be subjectively determined by weartesting, but also objectively measured and recorded with the use of thermometers and infrared thermography equipment.

In addition, conventional prior art athletic shorts including an inner liner which elevate and press the male reproductive organs against the pubic area of the torso are believed to adversely influence the production and operation of sex hormones and anabolic metabolism with respect to the process of adaptation and acquisition of athletic fitness. Endurance training such as distance running tends to lower testosterone levels, and generally, can suppress anabolic processes and functions within the body. The reasons for this are many, varied, and complex, but the acute cause primarily derives from the biochemistry of exercise as energy stores and electrolytes become depleted and de-hydration takes place. Moreover, demanding exercise is associated with other residual and chronic effects which can influence the operation of the endocrine system, thus shift the balance of the metabolism towards catabolism. For example, see the following articles which relate to this subject:

A. Hackney, et al., "Reproductive Hormonal Profiles of Endurance-Trained and Untrained Males," Medicine and Science in *Sports Exercise,* February, 1988; 20(1):60–65.

J. Arce, "Subclinical Alterations in Hormone and Semen Profile in Athletes," *Fertility and Sterility,* February, 1993; 59(2):398–404.

J. Arce, "Exercise and Male Factor Infertility," *Sports Medicine,* March, 1993; 15(3):146–169.

C. Jensen, et al., "Prospective Study of Hormonal and Semen Profiles in Marathon Runners," *Fertility and Sterility,* December, 1995; 64(6):1189–1196.

A. Bonen, et al., "Pituitary, Ovarian, and Adrenal Hormone Responses to Marathon Running," *International Journal of Sports Medicine,* December, 1987; 8 Supplement 3:161–167.

H. Tanaka, et al., "Persistent Effects of a Marathon Run on the Pituitary-Testicular Axis," *Journal of Endocrinological Investigation,* April, 1986; 9(2):97–101.

M. De Souza, et al., "Gonadal Hormones and Semen Quality in Male Runners. A Volume Threshold Effect of Endurance Training," *International Journal of Sports Medicine,* October, 1994; 15(7): 383–391.

J. Ayers, et al., "Anthropomorphic, Hormonal, and Psychological Correlates of Semen Quality in Endurance-Trained Male Athletes," *Fertility and Sterility,* June, 1985; 43(6): 917–921.

K. Kuoppasalmi, et al., "Plasma Cortisol, Androstenedione, Testosterone and Luteinizing Hormone in Running Exercise of Different Intensities," *Scandanavian Journal of Clinical Laboratory Investigation,* September, 1980; 40(5): 403–409.

A. Urhausen, et al., "Blood Hormones as Markers of Training Stress and Overtraining," *Sports Medicine,* October, 1995; 20(4): 251–276.

Moreover, it can be readily understood that a condition which has the capability of lowering sperm counts or affecting the viability of sperm, such as the "Jockey Shorts Effect," can via biofeedback relationships thereby also influence the body's production of testosterone and larger function of the endocrine system. Accordingly, the so-called "Jockey Shorts Effect" may then not simply be a matter of lower sperm counts or less viable sperm being produced, rather it is believed that such can have a wider impact upon an individual's metabolism. In this regard, it is believed that a tendency exists for the male metabolism to be shifted in the direction of catabolism to greater degree than would otherwise be the case. By continually altering the normal balance and relationship between the anabolic and catabolic processes, individuals might adversely affect both the rate and amount of acquisition, thus the potential improvement in fitness that would result from the conduct of athletic training.

It is known that the scrotum and testes will sometimes retract when a man is exposed to cold temperatures or engages in demanding physical exercise. The same phenomenon can also be observed when training horses or other mammals. In this regard, nature will normally take care of itself. Accordingly, several problems can be introduced by conventional prior art athletic shorts including an inner liner which elevate and press the male reproductive organs against to the pubic area of the torso. For example, even in warm or hot temperature conditions, the male reproductive organs can be held in a retracted position that is normally associated with the experience of cold temperatures. Further, the subsequent build-up of perspiration induced by such athletic shorts can result in excessive local cooling, and this can affect thermoregulation and metabolism. Even hours after exercise, when individuals do not remove their perspiration soaked conventional prior art athletic shorts, the male reproductive organs can remain in a relatively cold and retracted state. This condition can be associated with catabolism, thus delayed recovery from exercise and impaired acquisition.

Conventional prior art athletic shorts can also restrict flexion and extension of the legs, and distention of the abdomen during breathing. Both of these phenomenon can influence athletic performance in distance running and other activities. The inventor has two decades of experience as an athlete and coach of distance runners including a member of two U.S. Olympic Teams and a British National Champion upon which to base the practical insights and teachings recited herein.

Accordingly, the present invention teaches improved athletic shorts for use which do not substantially impair flexion or extension of the legs, or distention of the abdomen, nor adversely affect heat dissipation, thermoregulation, spermatogenisis, or normal function of the metabolism and endocrine system. Further, the present invention teaches novel athletic shorts which are both comfortable and attractive.

Moreover, the athletic shorts taught herein can be used with novel athletic pants disclosed in a co-pending patent application entitled "Anatomical and Shock Absorbing Athletic Pants," hereby incorporated by reference herein. Reference is also made to co-pending utility patent application entitled "Novel Underwear," and three design patent applications entitled, "Article of Apparel Having Non-Stretchlastic Anterior Waist Portion," "Athletic Shorts Inner Liner Having Non-Stretchlastic Anterior Waist Portion," and "Underwear Having Non-Stretchlastic Anterior Waist Portion," filed the same day as the present application, all of these patent application hereby being incorporated by reference herein.

SUMMARY OF THE INVENTION

The preferred athletic shorts for male and female wearers can facilitate relatively unrestricted flexion and extension of the legs, and distention of the abdomen during respiration. The athletic shorts can have a horizontal waistline on the anterior and posterior sides. The preferred athletic shorts includes retention means. The preferred retention means can include a non-stretchlastic material on the anterior side of the athletic shorts which does not in and of itself place a substantial spring preload upon the abdomen of a wearer. The anterior side of the athletic shorts preferably includes retention means substantially comprising a non-stretchlastic material. The anterior side of the athletic shorts preferably includes inferior retention means, and a superior edge forming a V shape. Alternately, the anterior side preferably includes inferior retention means, and a superior edge forming a U shape. The posterior side of the athletic shorts preferably has a horizontal waistline.

The preferred inner liner of athletic shorts for use by male or female wearers can be made of a single textile material, or a plurality of textile materials. The inner liner can include a relatively stretchlastic material, or alternately a relatively non-stretchlastic material. The inner liner can include a porous and breathable material. The inner liner can include a hydrophobic material, a hydrophilic material, or a combination thereof. The inner liner has an anterior side and a posterior side and can include a first textile material and a second textile material, and the first textile material used on the anterior side can exhibit greater elongation along the vertical axis relative to the horizontal axis, whereas the second textile material used on the posterior side can exhibit greater elongation along the horizontal axis relative to the vertical axis. Alternately, the preferred inner liner can include a textile material having different elongation characteristics in two directions, and on the anterior side the textile material can be orientated as to exhibit greater elongation along the vertical axis relative to the horizontal axis, and the textile material can be differently orientated on the posterior side as to exhibit greater elongation along the horizontal axis relative to the vertical axis.

The preferred inner liner of athletic shorts for use by male or female wearers can include elastic material bordering the two openings for accommodating the legs of a wearer. The preferred inner liner has a minimum width in the area between the two openings for accommodating the legs of a wearer in the range between one, and one and three quarters inches. The inner liner can include an area of differential elastic and stitching near the point of minimum width. The area of differential elastic and stitching can extend in the range between one and three inches on either side of the point of minimum width. In an alternate embodiment, the inner liner can include elastic material bordering the two openings which cross from left to right and right to left to form a X shape near the location of minimum width.

The present invention also teaches novel athletic shorts for a male wearer that permit the male reproductive organs to be substantially suspended naturally. This is believed to lower the temperatures to which the testes are subjected thereby increasing the rate and quality of spermatogenesis, and to facilitate greater heat dissipation. Further, this characteristic is believed to facilitate optimal thermoregulation. In addition, the preferred athletic shorts of the present invention are believed to positively influence the operation of sex hormones and metabolism regarding the process of adaptation and the acquisition of athletic fitness.

The preferred athletic shorts for use by a male wearer include an anterior side, posterior side, superior edge, and an outer layer which is affixed in functional relation to an inner liner. The inner liner includes two openings for accommodating the legs of a wearer and is configured for permitting the male reproductive organs to be substantially suspended naturally. The anterior side of the inner liner can be made from a single piece of textile material which is folded along the middle and stitched at the inferior edges. In an alternate embodiment, the anterior side of the athletic shorts for use by a male wearer can include an inner liner having inferior retaining means, and the outer layer can include superior retaining means.

DETAILED DESCRIPTION OF THE ILLUSTRATIVE EMBODIMENTS

The present invention teaches novel athletic shorts which permit the male reproductive organs to be substantially suspended naturally, that is, the preferred athletic shorts include an inner liner which does not substantially elevate or press the male reproductive organs against the torso near the area of the pubic synthesis. This is believed to lower the temperatures to which the testes are subjected thereby increasing the rate and quality of spermatogenesis, and to facilitate greater heat dissipation. Further, this characteristic is believed to facilitate optimal thermoregulation within the body. In addition, it is believed to positively influence the operation of sex hormones and anabolic metabolism with respect to the process of adaptation and the acquisition of athletic fitness. The novel athletic shorts for male and female wearers also facilitate relatively unrestricted flexion and extension of the legs, and distention of the abdomen during breathing.

Figure 1:
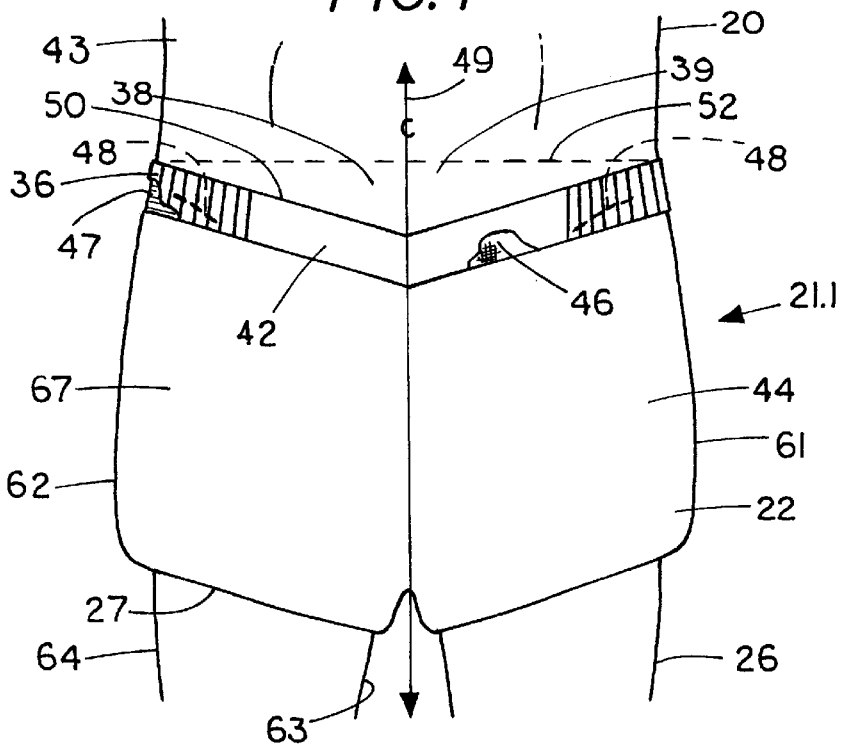
FIG. 1 is an anterior and external view of athletic shorts having a V shape, and a male wearer.
Figure 2:
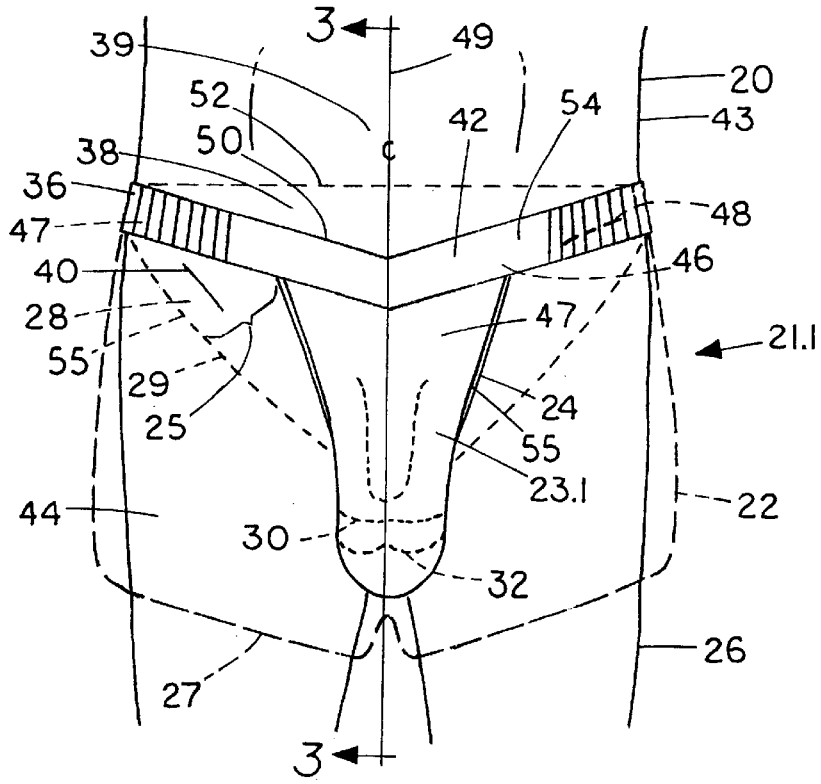
FIG. 2 is an anterior view of the athletic shorts shown in FIG. 1 with parts broken away, and a male wearer.

FIG. 1 shows the exterior of the anterior side 44 of a pair of preferred athletic shorts 21.1 shown in position on a male wearer 20. As shown in FIGS. 1–4, a male wearer 20 has donned a pair of preferred athletic shorts 21.1 having a superior edge 50 forming a V shape and having inferior retention means 42 on the anterior side 44. An alternate preferred athletic shorts 21.2 having a superior edge 50 forming an U shape and having inferior retention means 42 on the anterior side 44 is shown in FIG. 5. The preferred athletic shorts 21.1 have an outer layer 22 and an integral inner liner 23.1. The outer layer 22 and inner liner 23.1 can be affixed in function relation by sewing stitches 65 or other conventional means. The outer layer 22 and inner liner 23 can be affixed by sewing stitches 65 near their superior edges 50 and proximate retention mean 36, thus permitting the inner liner 23.1 to float relatively freely within the outer layer 22 of the athletic shorts 21.1. As shown, the inferior retention means 42 is substantially continuous on the anterior side 44 of athletic shorts 21.1, that is, inferior retention means 42 is not interrupted by closure means such clasp, button, or zipper, nor do athletic shorts 21.1 have a fly front. As shown in FIG. 2, the approximate location of the inferior edge of the posterior portion 28 of the inner liner 23 is shown by phantom line 29.

The athletic shorts 21.1 can be retained about the individual's abdomen 39 by retention means 36, such as string draw, elastic, button and hole, or other mechanical means, whether in partial or complete combination. However, in order to promote unrestricted breathing, it can be advantageous to use retention means 36 including a substantially non-stretchlastic material 46 on the anterior 44 of the athletic shorts 21.1, e.g., a material such as belting 54, and the like, which does not in and of itself place a spring preload upon the abdomen 39, in particular, the area of the rectus abdominus muscle 38 located between the opposing anterior aspect(s) of a wearer's iliac crest(s) 48.

Accordingly, it can be advantageous to terminate the use of conventional waistband stretchlastic material 47, and the like, on athletic shorts 21.1 within a short distance of the position corresponding to the approximate anterior position of a wearer's iliac crests 48 on each side of the abdomen 39, as shown in FIG. 1. It can be advantageous to use a conventional waistband made of stretchlastic material 47 having a width of at least three quarters of an inch, and a width of approximately one and one quarter inch is preferred for use in many applications of athletic shorts 21.1.

The inner liner 23.1 can substantially consist of a resilient or stretchlastic material 47 including natural fibers such as cotton, synthetic fibers such as polyester or polypropylene, nylon, or various blends of natural and synthetic fibers such as cotton and polyester. LYCRA® brand spandex, or various COOLMAX® textiles made or licensed by E.I. Dupont de Nemours Company can be used, and the like. Further, various textiles made by Milliken Research Corporation of Spartanburg, N.C., Burlington Industries, Inc. of Hurt, Va., or Darlington Fabrics Corporation of New York can be used, and the like. A stretchlastic material 47 can consist of two-way, three-way or any other type of stretchlastic material. However, the pattern of the inner liner 23.1 is configured so as to permit the male reproductive organs to be substantially suspended naturally. It can be advantageous to use a resilient or stretchlastic material 47 having greater vertical than horizontal elongation on the anterior side 44 of the inner liner 23.1 as this configuration can help to restrain anterior and side to side movement of the male reproductive organs while not elevating or pressing the male reproductive organs against the torso 43 near the area of the pubic synthesis 53. Further, it can be advantageous to use a resilient or stretchlastic material 47 having greater horizontal than vertical elongation on the posterior side 45 of the inner liner 23.1 as this can enhance fit with respect to a wearer's buttocks. A preferred textile for use in the inner liner 23.1 is sample No. FS-485, a fine wicking polyester mesh distributed by Yagi & Co., Ltd., of Osaka, Japan. Alternately, the inner liner 23.1 can partially or substantially consist of a relatively non-stretchlastic material 46 made of cotton, and the like. It can be readily understood that different textile materials 67 made of a particular material, such as cotton, can exhibit a wide range of elongation properties and be stretchlastic or non-stretchlastic, depending upon the type and size of the fibers, and also the type and size of the knit or weave. Again, the pattern of the inner liner 23.1 and the textile material(s) 67 used are configured to permit the male reproductive organs to be substantially suspended naturally.

The inner liner 23.1 can be formed of a material which is relatively porous, non-heat retaining, and breathable, or alternately, a material which is relatively non-porous and heat retaining depending upon the anticipated environmental conditions for which the athletic shorts are made. The former construction can be suitable for use in the summer months and hotter weather, and the latter can be suitable for use in winter months and cold weather in which a penetrating wind chill could be encountered. Select hydrophilic and/or hydrophobic materials, as well as materials having select thermal properties can be used in various configurations and combinations to make the preferred athletic shorts.

The inner liner 23.1 can also include elastic material 24 bordering the edge 55 of openings 25 for accommodating the wearer's legs 26. The preferred elastic material 24 is between approximately ⅛ and ⅜ths inches in width and in a medium sized pair of athletic shorts measures approximately 25 inches in length about each leg opening prior to elongation. Alternately, the inner liner 23.1 need not include elastic material 24 bordering the edge 55 of openings 25 for accommodating the wearer's legs 26 depending upon inherent elongation and stretchlastic properties of the textile material 67 used to make the inner liner 23.1. It can be advantageous for the elastic material 24 to be configured, e.g., as shown in FIGS. 2, 5, 8, 9, 12, 13, and 14 in order to avoid chafing against the inner or medial sides 63 of a wearer's 20 legs 26. The direction of pull of the stretchlastic material 46 and/or elastic material 24 will then not cause the inner liner 23.1 to be biased against or rub upon the inner or medial sides 63 of a wearer's 20 legs 26. Inner liner configurations that include more restrictive openings 25 for a wearer's 20 legs 26 which are encompassed by elastic material 24 at the edges 55 can result in chafing, and in particular, when such athletic shorts are used for distance running.

Conventional prior art athletic shorts including an inner liner can elevate and press the male reproductive organs against the torso 43 near the area of the pubic synthesis 53, as shown by phantom line 30 in FIG. 2. However, the present invention teaches an inner liner 23.1 which provides ample space to accommodate the natural elevation and descent of the male reproductive organs, and in particular, the scrotum 32 containing the testes. Accordingly, in the present invention the male reproductive organs are not substantially elevated or pressed against the torso 43 near the area of the pubic synthesis 53.

Figure 11A:
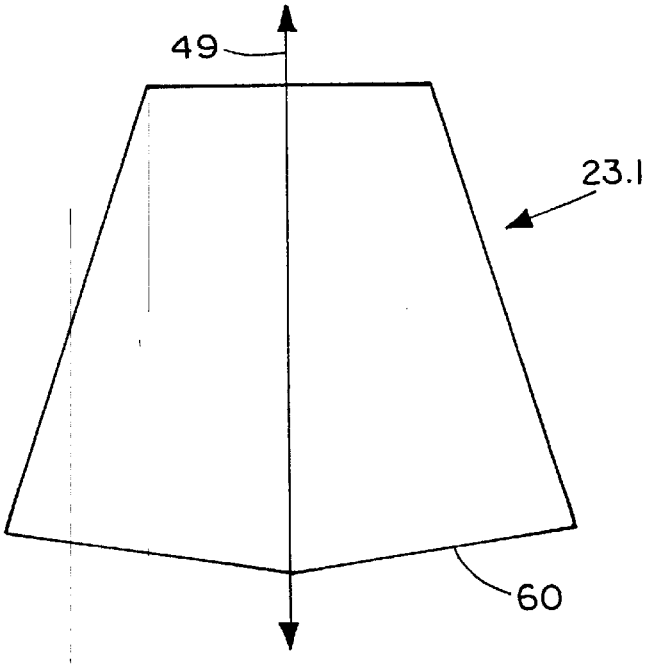
FIG. 11*a* is an anterior view of a piece of textile material for making a portion of the anterior side of an inner liner.
Figure 11B:
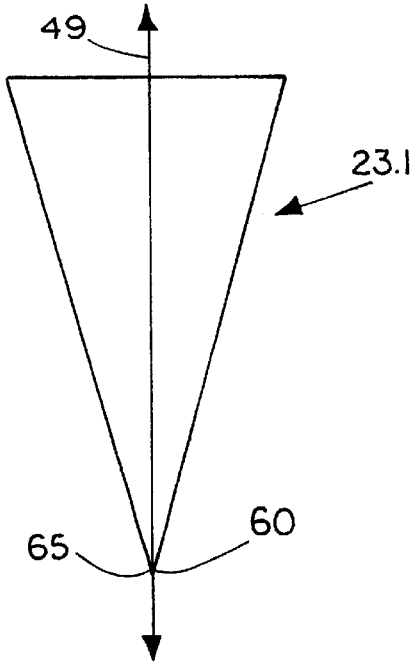
FIG. 11*b* is an anterior view of the piece of textile material shown in FIG. 11*a,* but folded and sewn at the inferior edge(s) to make a portion of the anterior side of an inner liner.

While numerous patterns can be used to form a suitable inner liner 23.1 in accordance with the teachings of the present invention, a preferred inner liner 23.1 can be made from a single piece of textile material 67 that is folded along the middle 49 and affixed, e.g., by sewing stitches or stitching 65, at the inferior edges 60, as illustrated in FIGS. 11*a,* and 11*b.* Again, it can be readily understood that a multiplicity of different patterns and textile materials can be used in order to construct the inner liner of the preferred athletic shorts. Accordingly, for the purpose of possibly assisting in determining the scope of the present invention in anticipation of possible future litigation, the test method of inserting a ball or sphere having a given diameter into position within the inner liner 23.1 of a preferred pair of athletic shorts 21.1 can be used. For reference, a tennis ball has a diameter of approximately 2.5 inches, a baseball 3.0 inches, and a softball 3.5 inches. However, it can be advantageous to use a hollow plastic ball or sphere when measuring the volume and amount of anatomical accommodation provided by a given inner liner. According to the teachings of the present invention, and as a minimum with respect to small, medium, large, or extra-large sizes of adult men's athletic shorts 21.1, an inserted ball or sphere having a diameter of 2.5 inches should not be restrained such that it is elevated and pressed against the torso 43 near the area of the pubic synthesis 53, that is, there should be some visible and measurable clearance between the ball and the torso 43 when the ball is inserted within the inner liner 23.1. Convention prior art athletic shorts including inner liners which elevate and press the male reproductive organs against the torso in the area of the pubic synthesis do not pass this test. A test using a 2.5 inch diameter sphere is preferably used with respect to small sized men's athletic shorts. With respect to medium sized men's athletic shorts, the inner liner is preferably configured such that an inserted sphere having a diameter of 3.0 inches will pass this test. With respect to large or extra large men's athletic shorts, the inner liner is preferably configured such that an inserted ball or sphere having a diameter of 3.5 inches will pass this test.

This test method is preferably conducted with the use of a suitable life size male model or mannequin which does not include representation of the male reproductive organs.

The outer layer 22 of the athletic shorts 21.1 can be made of natural fibers such as cotton, or synthetic fibers such as nylon, polyester, polypropylene, or various blends of natural and synthetic fibers. A breathable microfiber fabric is preferred with respect to athletic shorts intended for use during the summer months or torrid weather conditions. Manufacturers of suitable microfiber fabrics include Burlington Industries, Inc. of Hurt, Va., and Milliken Research Corporation of Spartanburg, N.C. A wind resistant rip-stop nylon fabric can be preferred with respect to athletic shorts intended for use in the winter or cold weather conditions, such as Sample No. AKL-4050 distributed by Yagi & Co., Ltd., of Osaka, Japan.

Shown in FIG. 2 is a front or anterior view 44 of the preferred athletic shorts 21.1 shown in FIG. 1, with parts broken away. Athletic shorts 21.1 include inferior retention means 42 and a superior edge 50 forming a V shaped configuration for facilitating respiration. Again, as shown in FIG. 5, an arcuate or U shaped configuration can also be suitable for use. It can be readily understood that athletic shorts having a superior edge 50 forming a U or V shape, and inferior retention means 42 on the anterior side 44 can be advantageous for use by female as well as male users. As shown in FIG. 2, a male wearer 20 has donned a pair of preferred athletic shorts 21.1 having an outer layer 22 and an inner liner 23.1. The outer layer 22 and inner liner 23.1 can be affixed in function relation by sewing stitches 65 or other conventional means. The outer layer 22 and inner liner 23.1 can be affixed by sewing stitches 65 near their superior edges 50 and proximate retention mean 36, thus permitting the inner liner 23.1 to float relatively freely within the outer layer 22 of the preferred athletic shorts 21.1. The configuration of inner liner 23.1 shown in FIG. 2 is advantageous in biasing elastic material 24 and/or non-stretchlastic 46 or stretchlastic material 47 of which the inner liner 23.1 is made away from contact with the inner or medial side 63 of a wearer's 20 legs 20, thus avoiding chafing. Also shown is a line indicating the middle 49 of the torso 43, and a dashed line indicating the normal position of a hypothetical conventional horizontal waistline 52.

Figure 5:
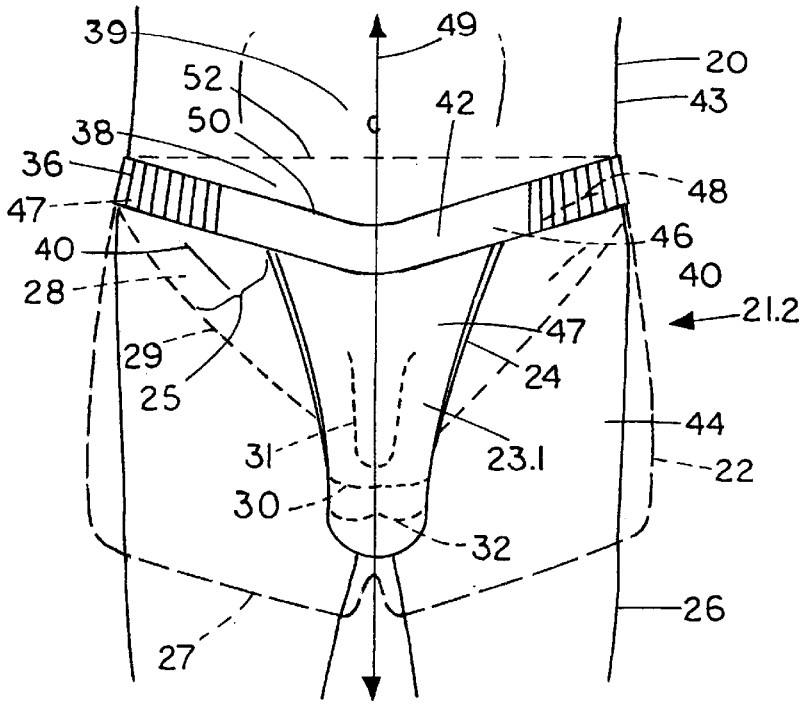
FIG. 5 is an anterior view of alternate athletic shorts having a U shape with parts broken away, and a male wearer.
Figure 6:
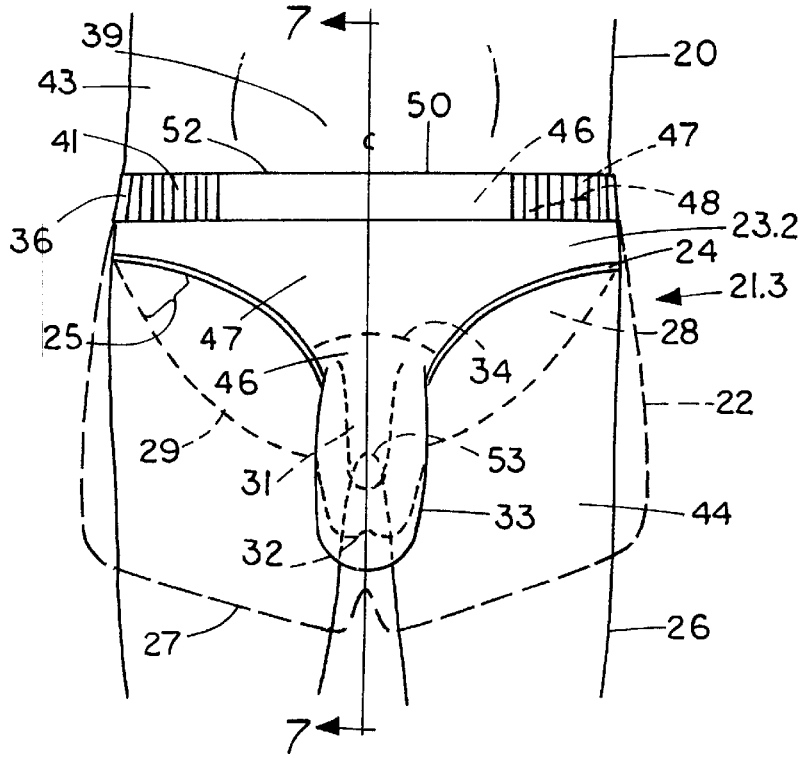
FIG. 6 is an anterior view of alternate athletic shorts having an inner liner including an appendage, with parts broken away, and a male wearer.
Figure 7:
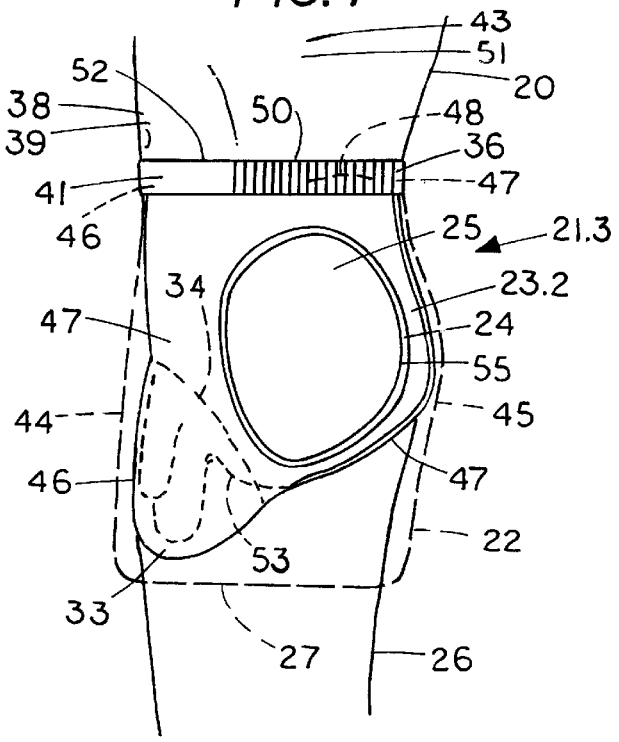
FIG. 7 is a side view of the alternate athletic shorts shown in FIG. 6, and a male wearer, with parts broken away.
Figure 8:
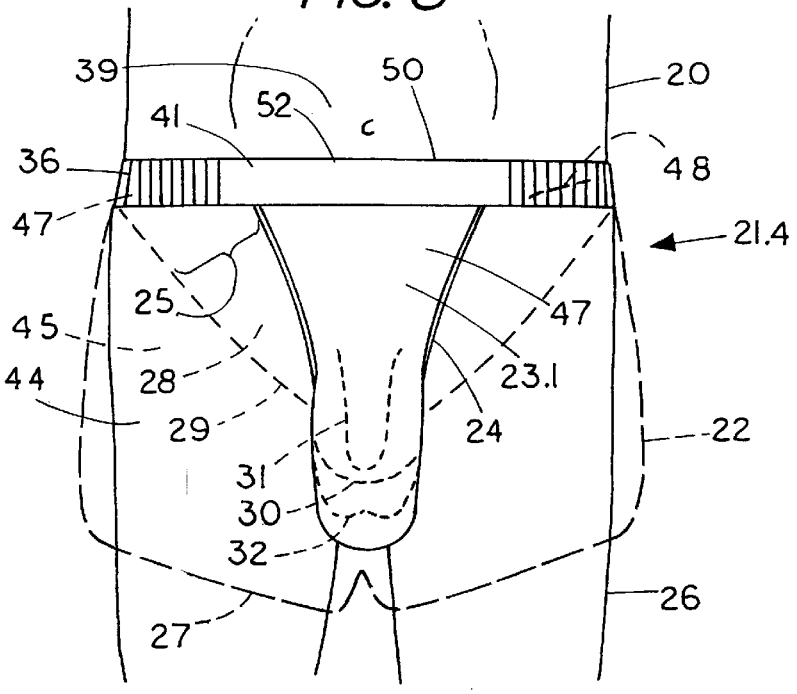
FIG. 8 is an anterior view of alternate athletic shorts having a horizontal waistline and an inner liner, showing parts broken away, and a male wearer.

Unlike the alternate preferred embodiments of athletic shorts shown in FIGS. 6–8, the preferred athletic shorts 21.1-2 shown in FIGS. 1, 2, 3, and 5, do not include superior retention means 41 on the front or anterior 44 side, that is, retention means 36 which extend substantially directly across the abdomen 39 in the manner of a conventional horizontal waistline 52. Instead, inferior retention means 42 are used on the front or anterior 44 side of the athletic shorts, that is, when viewed from the front or anterior 44 side, the left 61 and right 62 portions of the superior edge 50 and the retention means 36 of athletic shorts descend from areas proximate the opposing iliac crests 48 of the hips and the waist 35 of the wearer 20 at downward angles towards the middle 49 of the torso 43 and extends across the lower portion of the abdomen 39 so as to create an arcuate or U, or a V shaped configuration. In a medium size men's athletic shorts, it can be advantageous that the superior edge 50 at the middle 49 of athletic shorts having a U or V shaped configuration on the anterior side 44 be in the range between 1–4 inches inferior to that a conventional horizontal waistline 52, and preferably in the range between 2–3 inches. Relative to superior retention means 41, inferior retention means 42 better accommodates the anatomical structure of the lower portion of the rectus abdominis muscle 38 and distention of a wearer's 20 abdomen 39 during full respiration and hard physical exercise such as distance running. In FIG. 2, it can be readily understood that the line which indicates the middle 49 of the torso 43 is generally consistent with the vertical or z axis, and that the dashed line indicating the hypothetical position of a conventional horizontal waistline 52 is generally consistent with the horizontal or y axis.

Figure 3:
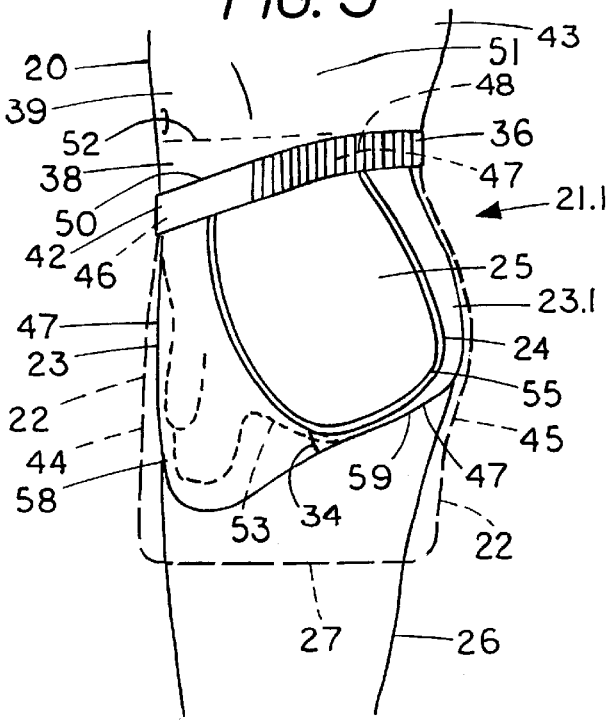
FIG. 3 is a side view of the athletic shorts shown in FIG. 1 and a male wearer, with parts broken away.

FIG. 3 is a side cross-sectional view of the preferred athletic shorts 21.1 shown in FIG. 2, with part of the wearer's leg broken away. The inner liner 23.1 can comprise a single material, or a plurality of different materials. Phantom line 34 shows one possible line of delimitation as between two different materials used in the fabrication of inner liner 23.1. The front or anterior 44 side of the inner liner 23.1 of athletic shorts 21.1, anterior of phantom line 34, can include a first textile material 58 which consists of a relatively less stretchlastic, or non-stretchlastic material 46, and the back or posterior 45 side of the inner liner 23.1 of the athletic shorts 21.1 can include a second textile material 59 which consists of a relatively stretchlastic material 47. Alternately, a single textile material 67 having greater relative elongation when stretched in one direction than another can be used in different orientations on the front or anterior side 44 versus the back or posterior side 45 of the inner liner 23.1. Again, such a textile material 67 can be oriented as to exhibit greatest elongation along the vertical or z axis on the front or anterior side 44, and orientated as to exhibit greatest elongation along the horizontal or x axis on the back or posterior side 45.

Figure 4:
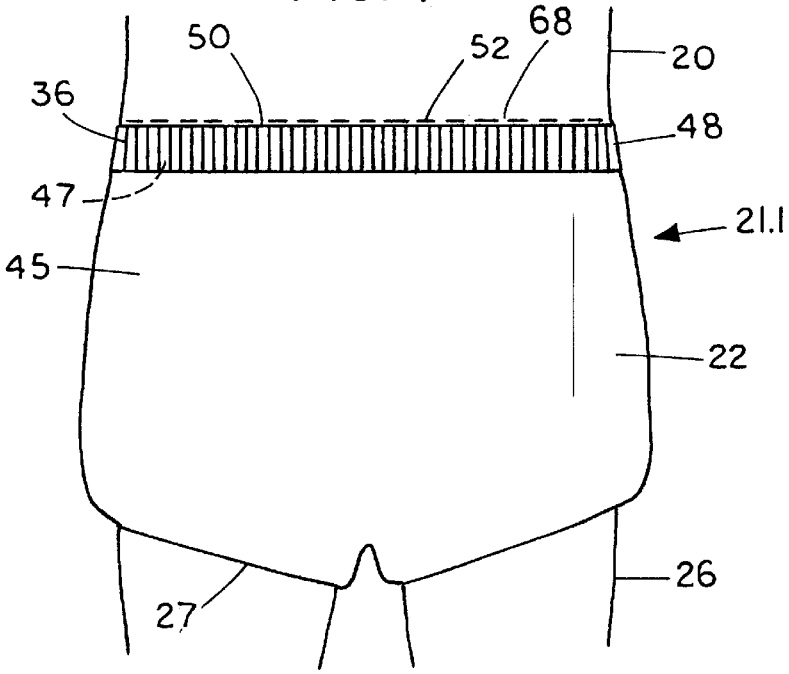
FIG. 4 is a posterior view of the athletic shorts shown in FIG. 1, and a male wearer.

FIG. 4 is a back or posterior 45 view of the preferred athletic shorts 21.1 shown in FIGS. 1–3. The superior edge 50 of the outer layer 22 on the back or posterior 45 side of the athletic shorts 21.1 can be consistent with a conventional horizontal waistline 52. It can be advantageous that the athletic shorts 21.1 be designed so that the superior edge 50 of the outer layer 22 is proximate and slightly superior with respect to the iliac crests 48 of the hips about a wearer's 20 sides 51 in order to help retain the athletic shorts 21.1 in optimal position.

Shown in FIG. 5 is a pair of alternate preferred athletic shorts 21.2 with parts broken away in position on a wearer 20, and having a superior edge 50 forming a U shape and inferior retention means 42 on the front or anterior side 44. Also shown is a line indicating the middle 49 of the wearer's 20 torso 43, and a dashed line indicating the normal position of a hypothetical conventional horizontal waistline 52. The athletic shorts 21.1-2 shown in FIGS. 1–5 can be advantageous for use in distance running.

FIG. 6 is an anterior view of alternate athletic shorts 21.3 with parts broken away. Shown is an alternate inner liner 23.2 including an appendage 33 for accommodating the male reproductive organs. The appendage 33 can consist of the same textile material 67, or alternately, a different textile material from that used to form the remainder of the inner liner 23.2. For example, a relatively non-stretchlastic material 46 can sometimes be used to form the appendage 33, whereas the remainder of the inner liner 23.2 can consist of a relatively stretchlastic material 47. Phantom line 34 shows one possible line of delimitation as between the use of two different textile materials 67 in the construction of an inner liner 23.2 including an appendage 33. An inner liner 23.2 including an appendage 33 is normally more complex and expensive to manufacture, and can result in greater chafing in some athletic applications. Accordingly, the inner liners 23.1 shown in FIGS. 1–5 are preferred for use in athletic shorts. As shown in FIG. 6, the superior edge 50 of the outer layer 22 along the back or posterior 45 side and front or anterior side 44 of the athletic shorts 21.3 consists of a horizontal waistline 52. Again, it can be advantageous that the athletic shorts 21.3 be designed so that the superior edge 50 of the outer layer 22 is proximate and slightly superior with respect to the iliac crests 48 of the hips about a wearer's 20 sides 51 in order to help retain the athletic shorts 21.3 in optimal position.

FIGS. 7 is a side view of the athletic shorts 21.3 shown in FIG. 6, donned on a male wearer 20, with parts of the wearer's leg broken away. The athletic shorts 21.3 shown in FIGS. 6 and 7 include retention means 36 consisting of superior retention means 41 and a horizontal waistline 52. However, the retention means 36 used on the front or anterior side 44 of the athletic shorts 21.3 substantially consists of a non-stretchlastic material 46 such as belting 54, and the like, which does not in and of itself place a spring preload upon the abdomen 39 of a wearer 20. The athletic shorts 21.3 shown in FIG. 7 include an inner liner 23.2 having openings 25 which encompass a wearer's 20 legs 26, whereas athletic shorts 21.4 shown in FIG. 8 include an inner liner 23.1 having larger openings 25 which only partially encompass a wearer's legs 26.

FIG. 8 is an anterior view of alternate athletic shorts 21.4, with parts broken away, including an inner liner 23.1 for accomodating the male reproductive organs. Accordingly, the male reproductive organs are not substantially elevated or pressed against the torso 43 near the area of the pubic synthesis 53. As shown in FIG. 8, athletic shorts 21.4 have a horizontal waistline 52 and retention means 36 consisting of superior retention means 41 on the anterior side 44 and posterior side 45.

Figure 9:
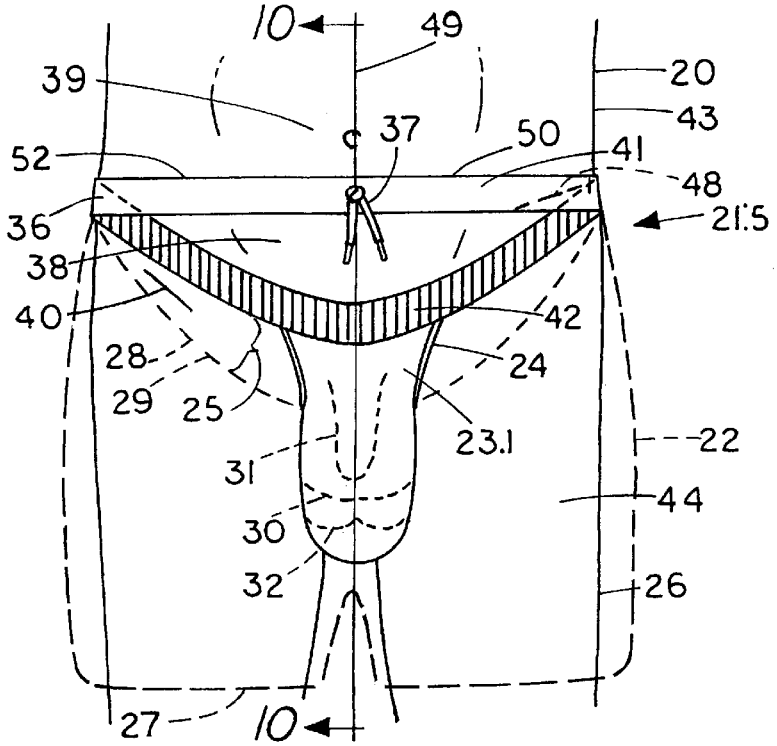
FIG. 9 is an anterior view of athletic shorts having superior retention means and inferior retention means, showing parts broken away, and a male wearer.

Shown in FIG. 9 is a pair of alternate preferred athletic shorts 21.5 having an outer layer 22 with parts broken away, and an inner liner 23. The athletic shorts 21.5 are retained about the individual's abdomen 39 by a combination of superior retention means 41 and inferior retention means 42. Superior retention means 41 correspond to outer layer 22 and extend across the abdomen 39 of male wearer 20 consistent with a horizontal waistline 52, thus approximately perpendicular to the middle 49 of the torso 43 and vertical or z axis. Inferior retention means 42 correspond to inner liner 23.1 and extend about the lower portion of the abdomen 39 as to resemble a generally arcuate U shaped configuration as shown, or V shaped configuration which is not shown. Relative to superior retention means 41, inferior retention means 42 better accommodates for the anatomical structure of the lower portion of the rectus abdominis muscle 38, and the distention of the wearer's 20 abdomen 39 during full respiration and hard physical exertion. Accordingly, when a pair of athletic shorts 21.5 is made that includes both superior retention means 41 and inferior retention means 42, it can be advantageous that superior retention means 41 exert relatively little biasing pressure and no restriction upon distention of the abdomen 39, and that the larger part of the force required to retain the athletic shorts 21.5 upon a wearer 20 on the anterior side 44 be imparted in the area of the lower abdomen 39 and torso 43 by inferior retention means 42. The athletic shorts 21.5 shown in FIGS. 9 and 10 can be advantageous for use, e.g., in basketball, volleyball, and boxing.

Figure 10:
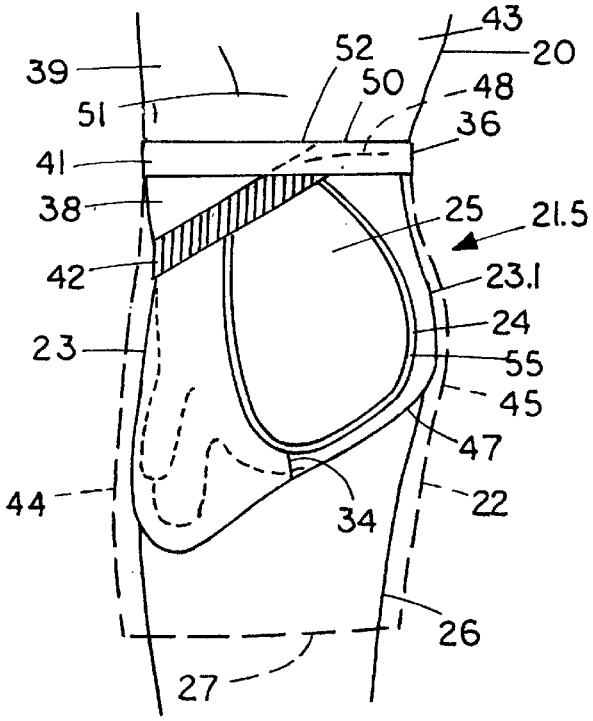
FIG. 10 is a side view of the athletic shorts shown in FIG. 9, and a male wearer, with parts broken away.

FIG. 10 is a side view of the athletic shorts 21.5 shown in FIG. 9 with part of the wearer's leg broken away. Again, the inner liner 23.1 can comprise a single material, or a plurality of different materials. Phantom line 34 shows one possible line of delimitation as between two different materials which are used to fabricate inner liner 23.1, or alternately, a single material which can be orientated differently on the front or anterior side 44 relative to the back or posterior side 45. As shown in FIG. 10, the superior edge 50 of the athletic shorts 21.5 is consistent with a horizontal waistline 52.

Figure 12:
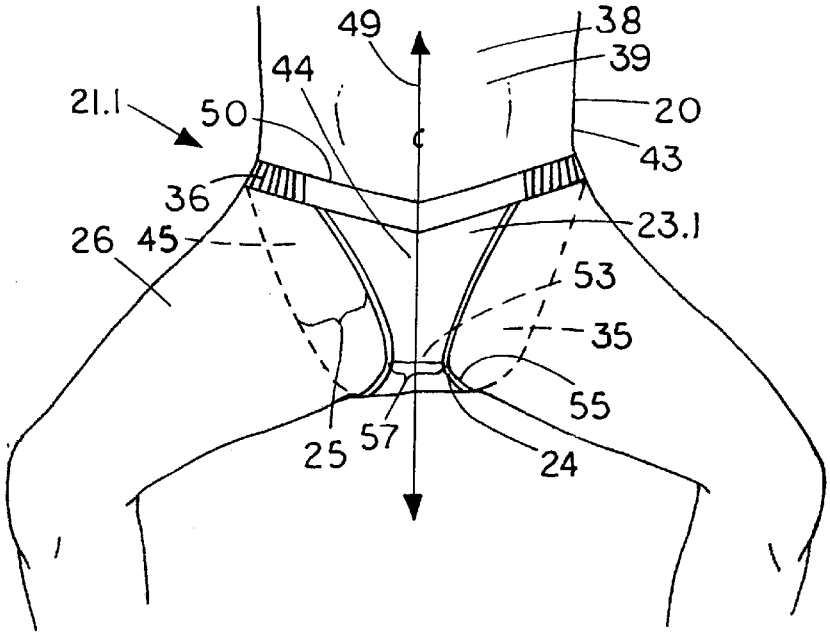
FIG. 12 is a bottom perspective view of an inner liner in position on a male wearer.
Figure 13:
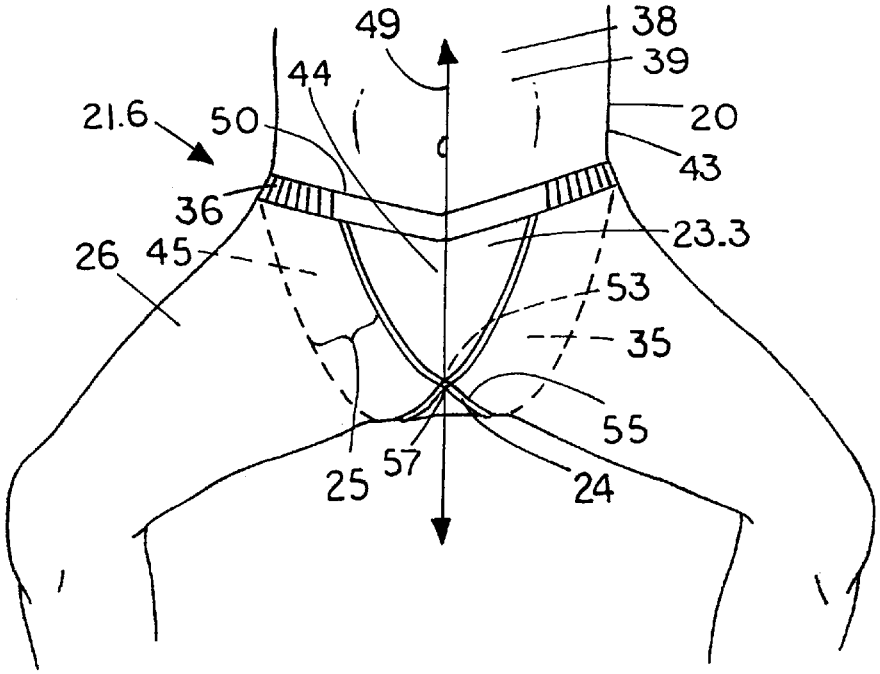
FIG. 13 is a bottom perspective view of an alternate inner liner in position on a male wearer having elastic material configured in an X shape.

As shown in FIG. 12, it can be advantageous that the inner liner 23.1 of athletic shorts 21.1 be made in a preferred range in width where it passes between a wearer's 20 legs 26 and attains its narrowest dimension or minimum width 57. On one hand, if the minimum width 57 is too narrow in this area, then the inner liner 23.1 can ride up in thong like fashion between the cheeks of a wearer's 20 buttocks 35 causing chafing and discomfort. On the other hand, if the minimum width 57 is too wide in this area, the direction of pull of the elastic material 34 and/or stretchlastic material 47 can be such as to bias the inner liner 23.1 against the inner or medial side 63 of the wearer's 20 legs 26 causing chafing and discomfort. For an individual who wears size medium athletic shorts, e.g., an individual having a 34 inch waist, the preferred range of the minimum width 57 in the area between a wearer's 20 legs 26 is between one and one and three quarters inches. Shown in FIG. 13, is an alternate, but not preferred, athletic shorts 21.6, with parts broken away. Elastic material 24 cross opposite sides of the torso 43 from right 62 to left 61 and left 61 to right 62 between the anterior side 44 and posterior side 45 of the inner liner 23.3 to form an X shaped configuration 56 near the area of minimum width 57.

Figure 14:
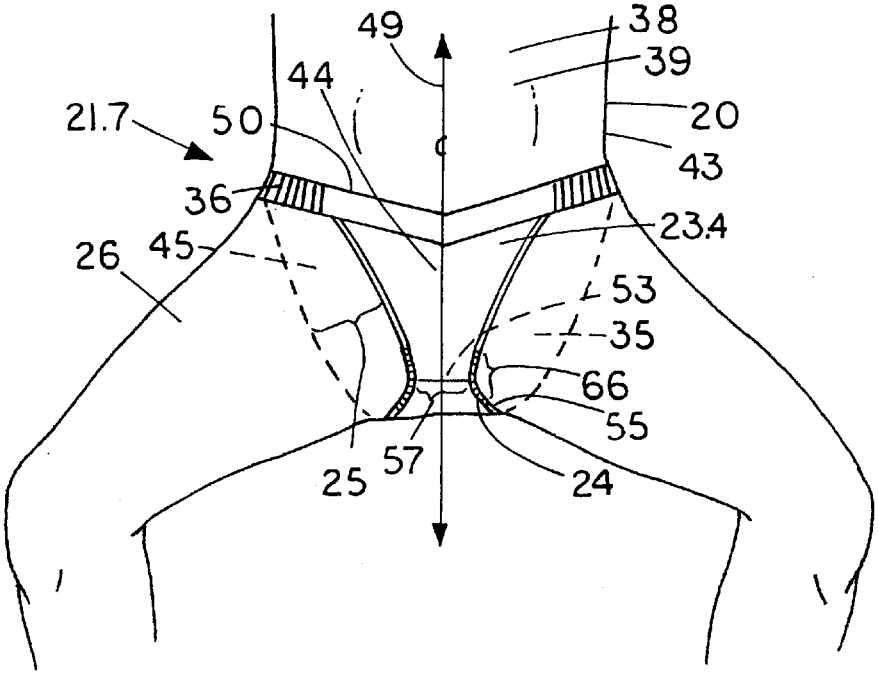
FIG. 14 is a bottom perspective view of an inner liner in position on a male wearer having an area of differential elastic and stitching near the point of minimum width.

As shown in FIG. 14, which is a bottom view of preferred athletic shorts 21.7 having parts broken away showing an inner liner 23.4 in position on a male wearer 20, it can be advantageous to include an area of differential elastic and stitching 66 near the point of minimum width 57. Accordingly, in a medium sized pair of athletic shorts 21.7, it can be advantageous that near the edge 55 of openings 25 for a wearer's 20 legs 26 that between one and three inches in length on either side of the location associated with the point of minimum width 47 of the inner liner 23.4 consist of an area of differential elastic and stitching 66. It can be advantageous that a stitching pattern characterized by relatively low surface roughness there be used, and that the configuration of the elastic material 24 and inner liner 23.4, as affixed by stitching 65, have a low profile and relatively smooth edges. Further, when the elastic material 24 and inner liner 23.4 are affixed together by stitching 65, it can be advantageous that the elastic material 24 not be elongated, or alternately, not be greatly elongated in the desired area of differential elastic and stitching 66, as this can cause bunching of the inner liner 23.4 which can result in chafing during use. It is also possible for elastic material 24 to be omitted in the area of differential elastic and stitching 66, or to use an elastic material 24 which imparts relatively less force when elongated. An area of differential elastic and stitiching 66 can be advantageous for use in all embodiments of preferred athletic shorts 21.

Figure 15:
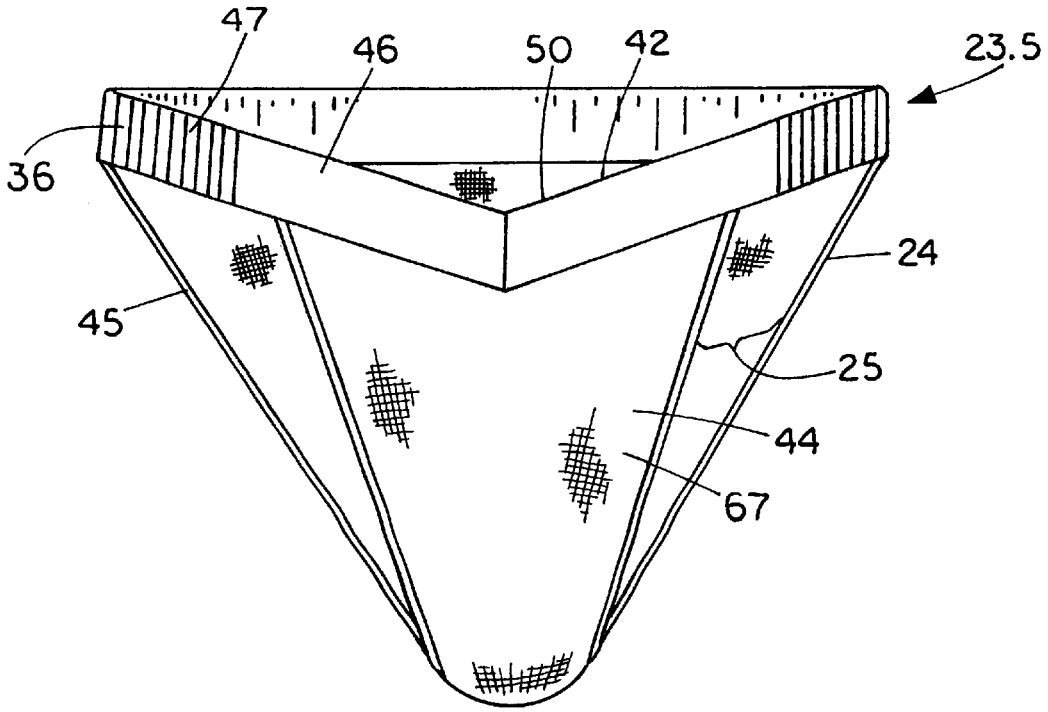
FIG. 15 is an anterior view of an inner liner of having a V shape for a female wearer.

FIG. 15 is an anterior view of an inner liner 23.5 of athletic shorts 21.8 for use by a female wearer 20.5. The athletic shorts 21.8 include retention means 36 consisting of inferior retention means 42 and a superior edge 50 on the anterior side 44 forming a V shape. The inferior retention means 42 consists of a substantially non-stretchlastic material 46. It can be readily understood with respect to any or all of the articles of apparel for use by female wearers shown in FIGS. 15–22, that the design and pattern of the inner liner can also serve as that for the outer layer of various alternate embodiments of athletic shorts, that is, the inner liner can be affixed in function relation to an outer layer having a substantially similar design and pattern which overlays the inner liner. Alternately, either the inner liner or outer layer can be omitted altogether, and a single textile material can then serve both functions.

Figure 16:
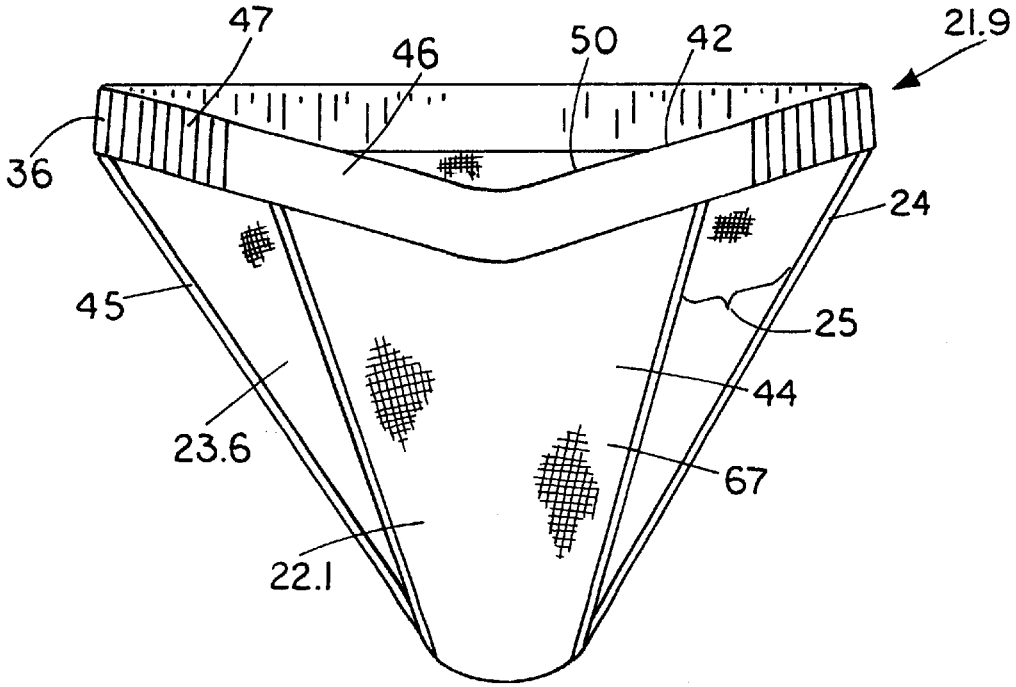
FIG. 16 is an anterior view of an outer layer having a U shape for a female wearer.

FIG. 16 is an anterior view of an outer layer 22.1 of athletic shorts 21.9 for use by a female wearer 20.5. The athletic shorts 21.9 include retention means 36 consisting of inferior retention means 42 and a superior edge 50 on the anterior side 44 forming a U shape. The inferior retention means 42 consists of a substantially non-stretchlastic material 46. Inner liner 23.6 consists of substantially the same design and pattern and underlays the outer layer 22.1.

Figure 17:
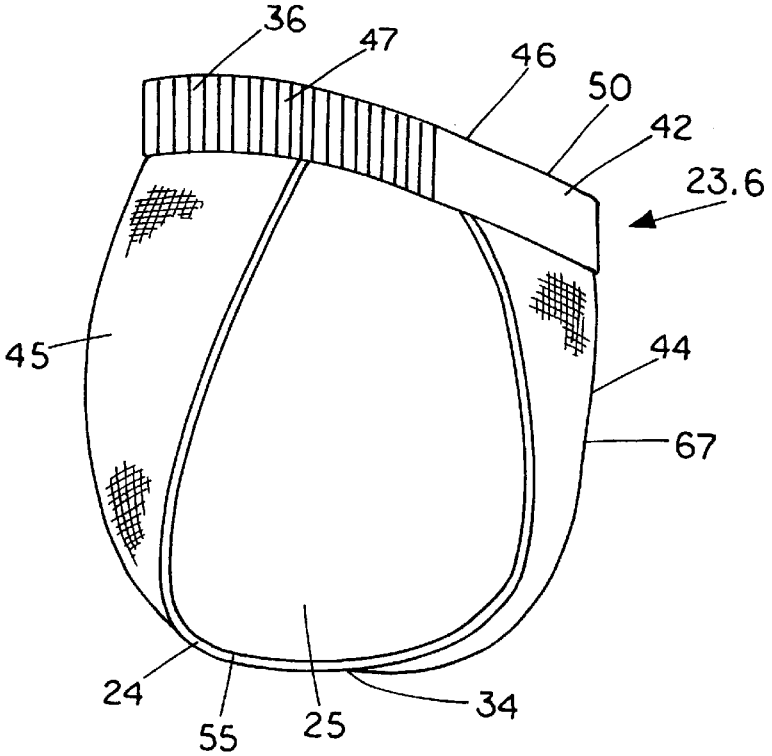
FIG. 17 is a side view of the inner liner shown in FIG. 15.

FIG. 17 is a side view of the inner liner 23.5 of athletic shorts 21.8 for a female wearer 20.5 shown in FIG. 15.

Figure 18:
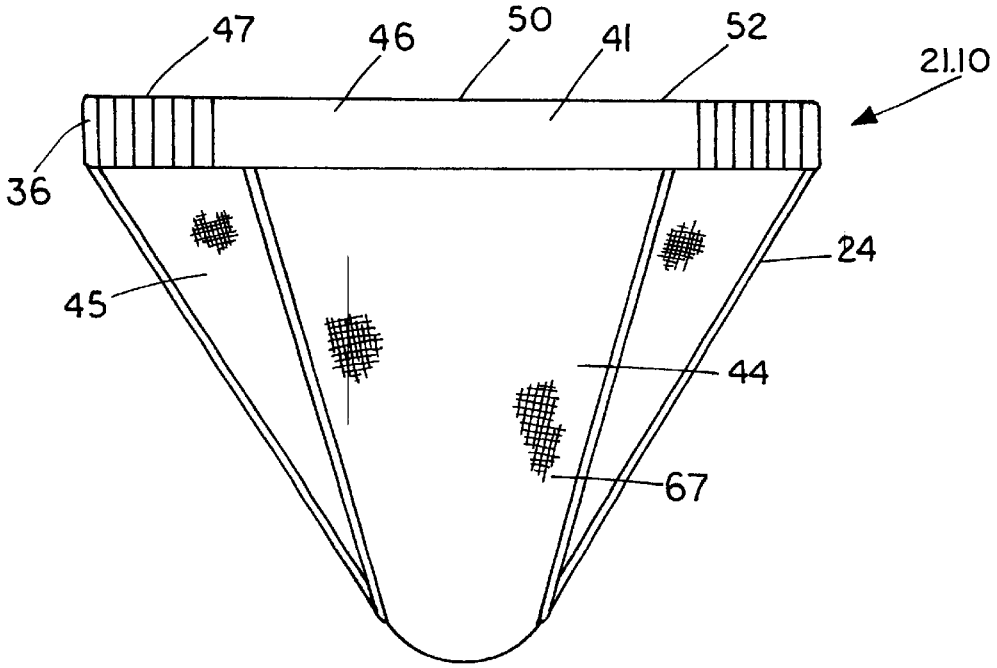
FIG. 18 is an anterior view of alternate athletic shorts having a horizontal waistline for a female wearer.

FIG. 18 is an anterior view of alternate athletic shorts 21.10 for use by a female wearer 20.5. The athletic shorts 21.10 include retention means 36 consisting of superior retention means 41 and a superior edge 50 forming a horizontal waistline 52 on the anterior side 44. The superior retention means 41 consists of a substantially non-stretchlastic material 46. Further, in this alternate embodiment of athletic shorts 21.10, a single layer of textile material 67 serves the dual purpose and function of an inner liner and outer layer.

Figure 19:
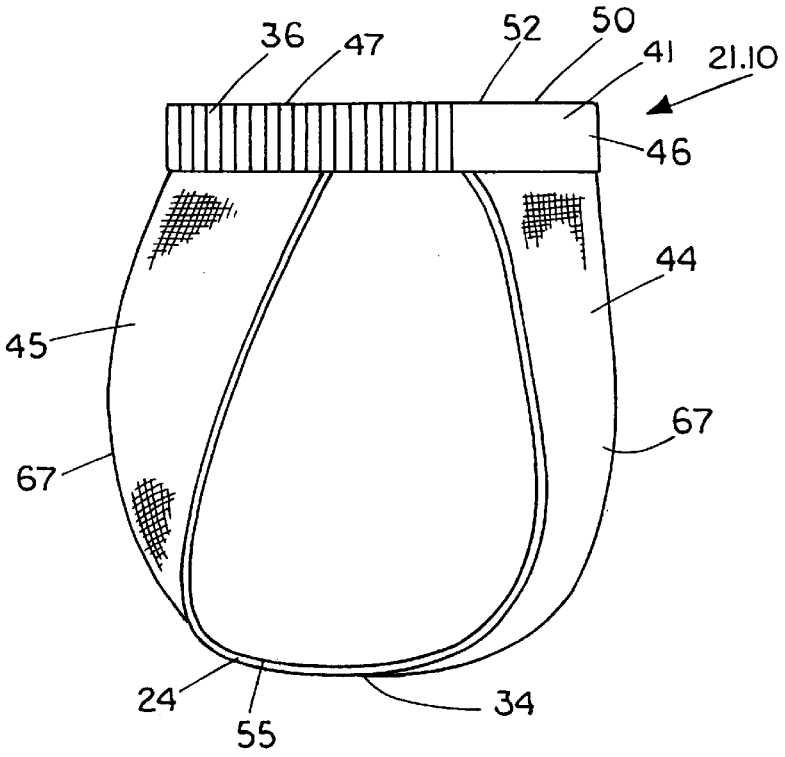
FIG. 19 is a side view of the athletic shorts shown in FIG. 18.

FIG. 19 is a side view of the athletic shorts 21.10 for a female wearer 20.5 shown in FIG. 18.

Figure 20:
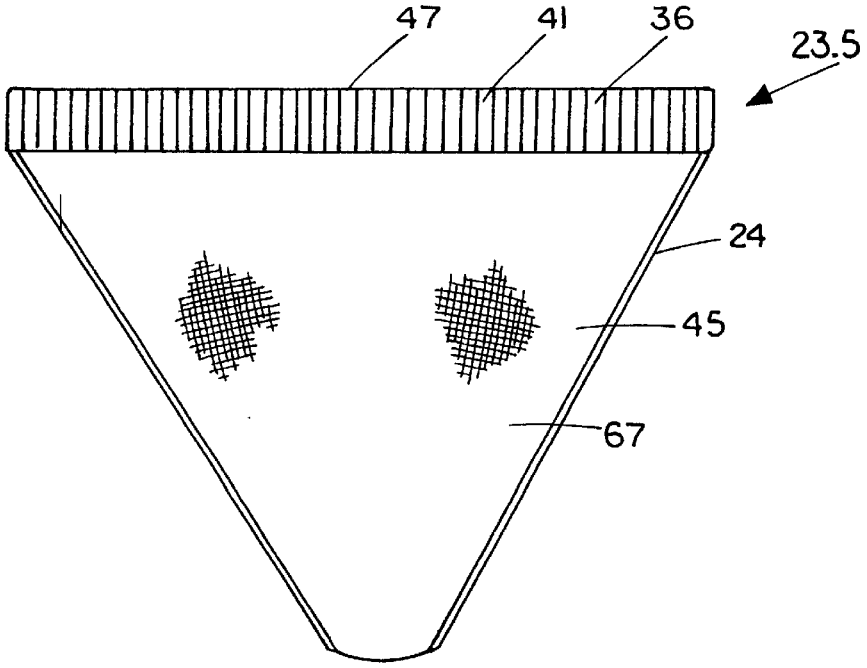
FIG. 20 is a posterior view of the inner liner shown in FIG. 15.

FIG. 20 is a posterior view of the inner liner 23.5 of athletic shorts 21.8 for a female wearer 20.5 shown in FIG. 15.

Figure 21:
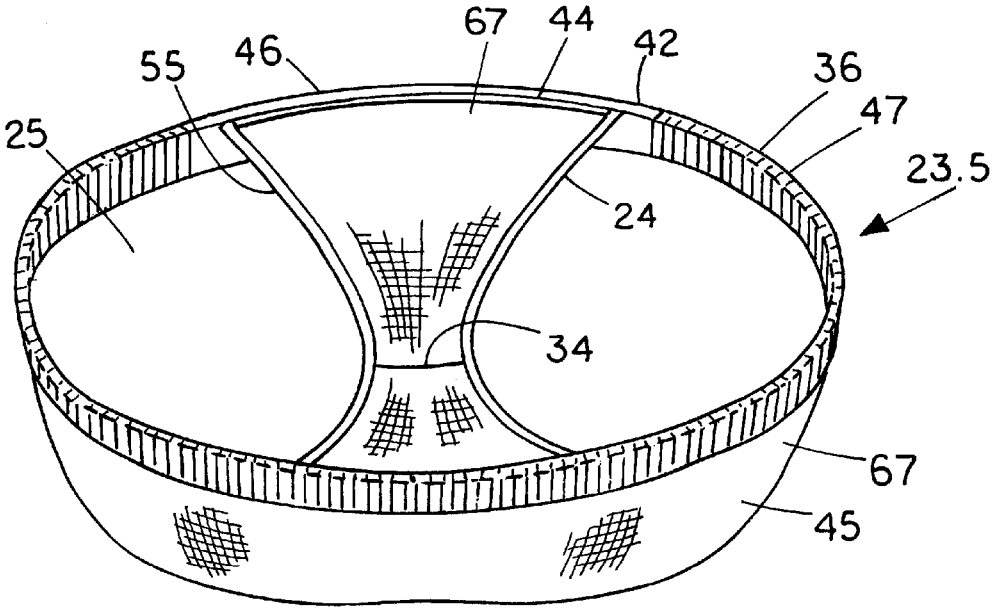
FIG. 21 is a top view of the inner liner shown in FIG. 15.

FIG. 21 is a top view of the inner liner 23.5 of athletic shorts 21.8 for a female wearer 20.5 shown in FIG. 15.

Figure 22:
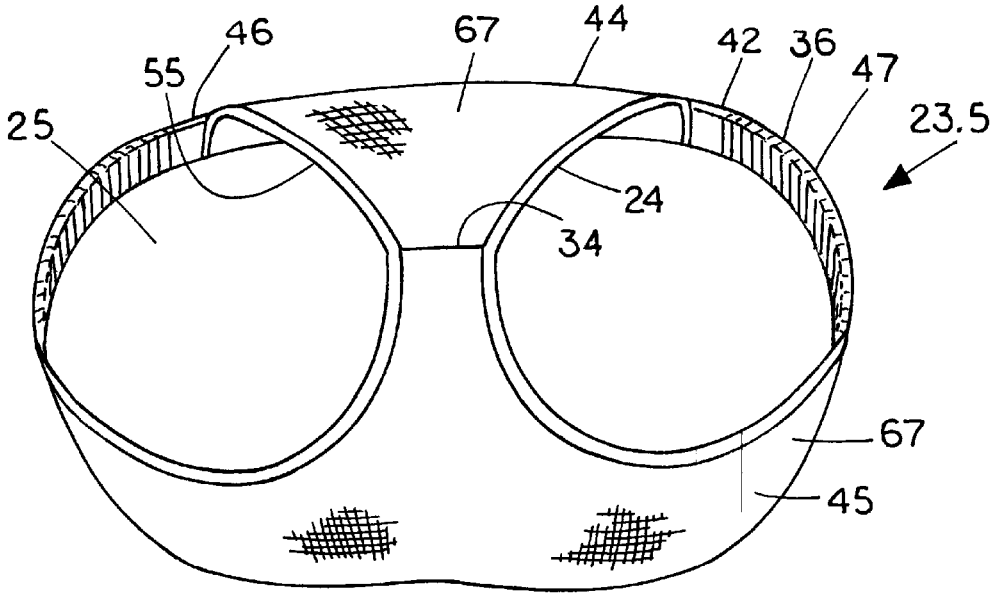
FIG. 22 is a bottom view of the inner liner shown in FIG. 15.

FIG. 22 is a bottom view of the inner liner 23.5 of athletic shorts 21.8 for a female wearer 20.5 shown in FIG. 15.

The athletic shorts taught in the present invention can be advantageous for casual, recreational, or athletic use, e.g., in such varied sports as running, soccer, basketball, volleyball, and tennis. It can be readily understood that athletic shorts having a superior edge forming a U or V shape, and inferior retention means on the anterior side substantially consisting of a non-stretchlastic material, as taught in the present invention, can be used in combination with a conventional inner liner. Likewise, a preferred inner liner as taught in the present invention can be used in combination with athletic shorts having a conventional horizontal waistline and superior retention means consisting of stretchlastic material. Further, it can be readily understood that various features of the athletic shorts disclosed herein, and various features and teachings associated with the aforementioned co-pending utility and design patent applications by the present inventor, filed the same day as the present application, and previously incorporated by reference herein, can possibly be combined, as desired.

While the above detailed description of the invention contains many specificities, these should not be construed as limitations on the scope of the invention, but rather as exemplifications of several preferred embodiments thereof. Many other variations are possible. Accordingly, the scope of the invention should be determined not by the embodiments discussed or illustrated, but by the appended claims and their legal equivalents.

Although the present invention has been described with reference to preferred embodiments, workers skilled in the art will recognize that changes may be made in form and detail without departing from the spirit and scope of the invention.

What is claimed is:

1. Athletic shorts for use by a wearer having an abdomen, torso, legs, and opposing iliac crests each having an anteriormost portion, said athletic shorts comprising an anterior side having a middle, a posterior side, a left side, a right side, a superior edge, a textile material, two openings for accommodating said legs of said wearer, and retention means, said retention means substantially comprising a substantially non-elastic material located in the middle of said anterior side and extending substantially across said wearer's abdomen between the anteriormost portion of each of said wearer's opposing iliac crests, and said retention means substantially comprising a substantially elastic material on said posterior side, said left side, and said right side.

2. The athletic shorts according to claim 1, wherein said non-elastic material comprises belting.

3. Athletic shorts for use by a wearer comprising an anterior side, posterior side, superior edge, and retention means, said athletic shorts comprising a substantially horizontal superior edge on said posterior side, said anterior side comprising inferior retention means substantially comprising a non-elastic material and a superior edge comprising a U shape.

4. Athletic shorts for use by a wearer comprising an anterior side, posterior side, superior edge, and retention means, said athletic shorts comprising a substantially horizontal superior edge on said posterior side, said anterior side comprising inferior retention means substantially comprising a non-elastic material and a superior edge comprising a V-shape.

5. The athletic shorts according to claim 4, further comprising an outer layer, and inner liner, said outer layer being affixed in functional relation to said inner liner, said inner liner comprising two openings for accommodating the legs of a wearer.

6. The athletic shorts according to claim 4, wherein the superior edge in the middle of said anterior side is inferior to the superior edge of said posterior side in the range between one and four inches.

7. The athletic shorts according to claim 5, wherein said inner liner comprises an elastic material.

8. The athletic shorts according to claim 5, wherein said inner liner comprises a porous and breathable material.

9. The athletic shorts according to claim 5, wherein said inner liner comprises elastic material bordering said two openings.

10. The athletic shorts according to claim 5, said inner liner comprising a minimum width in the area between said two openings, said minimum width comprising the range between one and one and three quarters inches.

11. The athletic shorts according to claim 10, said inner liner comprising an area of differential elastic and stitching near the location of said minimum width.

12. The athletic shorts according to claim 9, said elastic material comprising an X shape.

13. The athletic shorts according to claim 5, wherein said inner liner comprises a first textile material, a second textile material, an anterior side, and a posterior side, and said first textile material used on said anterior side comprises greater elongation along the vertical axis relative to the horizontal axis, whereas said second textile material used on said posterior side comprises greater elongation along the horizontal axis relative to the vertical axis.

14. The athletic shorts according to claim 5, wherein said inner liner comprises a textile material having different elongation characteristics in two directions, said textile material orientated as to comprise greater elongation along the vertical axis relative to the horizontal axis on said anterior side, and said textile material orientated as to comprise greater elongation along the horizontal axis relative to the vertical axis on said posterior side.

15. Athletic shorts for use by a male wearer comprising an anterior side, posterior side, superior edge, outer layer, and inner liner, said outer layer being affixed in functional relation to said inner liner, said inner liner comprising two openings for accommodating the legs of a wearer and comprising a configuration for permitting the male reproductive organs to be substantially suspended naturally along the vertical axis while substantially restraining anterior and side to side movement of said male reproductive organs.

16. The athletic shorts according to claim 15, said inner liner substantially comprising a single piece of textile material on the anterior side, the inner liner being folded along the middle and stitched at inferior edges of the inner liner.

17. The athletic shorts according to claim 15, comprising a substantially horizontal superior edge on said posterior side, said anterior side comprising inferior retention means and a superior edge comprising a V shape.

18. The athletic shorts according to claim 15, comprising a substantially horizontal superior edge on said posterior side, said anterior side comprising inferior retention means and a superior edge comprising a U shape.

19. Athletic shorts for use by a male wearer comprising an anterior side, posterior side, outer layer and inner liner, said outer layer being affixed in functional relation to said inner liner, said inner liner comprising two openings for accommodating the legs of a wearer and having a configuration for permitting the male reproductive organs to be substantially suspended naturally, and the anterior side of said inner liner comprises inferior retaining means, and the anterior side of said outer layer comprises superior retaining means.

* * * * *